United States Patent [19]

Sata et al.

[11] 4,087,893

[45] May 9, 1978

[54] PROCESS FOR PRODUCING A HEAT PIPE

[75] Inventors: Takeo Sata; Masayuki Takamura; Norio Shinoda; Masataka Hatae, all of Hamamatsu, Japan

[73] Assignee: Nippon Gakki Seizo Kabushiki Kaisha, Japan

[21] Appl. No.: 628,977

[22] Filed: Nov. 5, 1975

[30] Foreign Application Priority Data

Nov. 8, 1974 Japan ..... 49-128053
Feb. 7, 1975 Japan ..... 50-15373

[51] Int. Cl.[2] ..... B23P 15/26; B21C 23/10

[52] U.S. Cl. ..... 29/157.3 A; 29/423; 72/253 R

[58] Field of Search ..... 29/157.3 R, 423, 157.3 A, 29/DIG. 47; 165/105; 72/253, 258

[56] References Cited

U.S. PATENT DOCUMENTS

| | | | |
|---|---|---|---|
| 1,574,551 | 2/1926 | Bumford | 29/423 |
| 2,628,417 | 2/1953 | Peyches | 29/423 |
| 2,983,994 | 5/1961 | Johnson | 29/423 |
| 2,986,810 | 6/1961 | Brick | 29/423 |
| 3,064,345 | 11/1962 | Herman et al. | 29/423 |
| 3,138,856 | 6/1964 | Kuchek | 29/423 |
| 3,205,692 | 9/1965 | Kemppinen et al. | 29/423 |
| 3,267,564 | 8/1966 | Keyes | 29/157.3 A |
| 3,402,767 | 9/1968 | Bohdansky et al. | 165/105 |
| 3,564,566 | 2/1971 | Heitman | 29/423 |
| 3,598,177 | 8/1971 | Webster | 165/105 |
| 3,602,297 | 8/1971 | Kraft | 165/105 |
| 3,735,476 | 5/1973 | Deribas et al. | 29/423 |
| 3,795,970 | 3/1974 | Keathley et al. | 29/423 |
| 3,921,701 | 11/1975 | Cordone | 29/156.4 WL |
| 3,985,477 | 10/1976 | Antrim et al. | 29/423 |

*Primary Examiner*—E. M. Combs
*Assistant Examiner*—Daniel C. Crane
*Attorney, Agent, or Firm*—Ostrolenk, Faber, Gerb & Soffen

[57] ABSTRACT

Through employment of a core-and-sheath construction having a number of axially elongated indentations along the border for the billet with the core of an easily soluble material, extrusion such as hydrostatic extrusion can advantageously be utilized for production of heat pipes with enhanced precision and operational efficiency in process. Indentations, which work as a wick in the heat pipe, may be provided by forming axially elongated grooves either in the inner peripheral surface of the sheath or in the outer peripheral surface of the core.

17 Claims, 7 Drawing Figures

Fig. 1
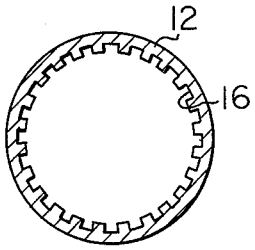
Fig. 2
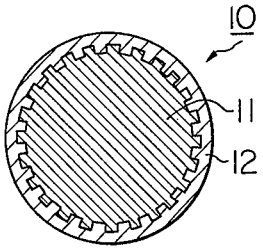
Fig. 3
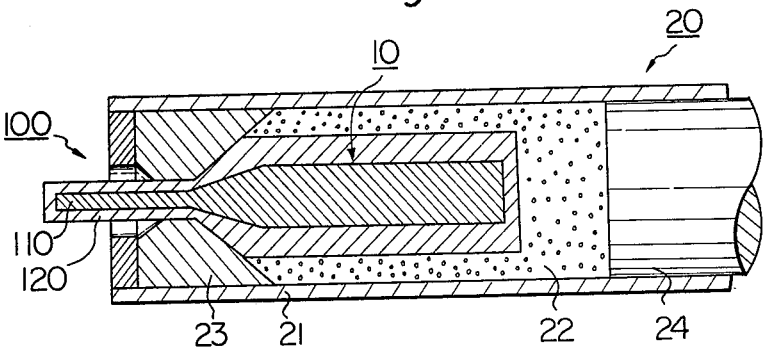
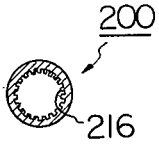
Fig. 4
Fig. 5
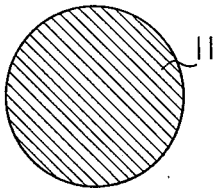
Fig. 6
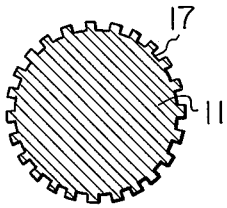
Fig. 7
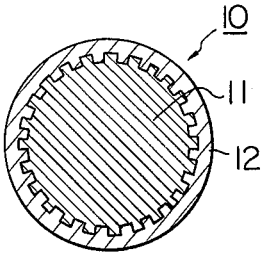

PROCESS FOR PRODUCING A HEAT PIPE

BACKGROUND OF THE INVENTION

The present invention relates to a process for producing a heat pipe, and more particularly relates to a process for producing a heat pipe by a novel combination of use of a billet of a core-and-sheath construction including the core of an easily soluble material with use of an extrusion such as hydrostatic extrusion.

A heat pipe is well known as a heat conductive element which transmits heat from one place to another place while utilizing heat exchange caused by movement of operating fluid confined in the pipe. Capillary action of the wick provided inside of the heat pipe promotes and smoothes this movement of the operating fluid from one end to the other end in the heat pipe.

In order to obtain sufficient capillary action, it is necessary for the wick of the heat pipe to have numerous fine holes or cavities which run in succession in the longitudinal direction of the wick.

Conventionally, such wicks are produced by using sinter metals. However, the process based on the use of sinter metals is accompanied with such drawbacks as relatively low precision in process and operational efficiency in the production process.

It is the object of the present invention to provide a novel process for producing heat pipes with remarkably enhanced precision and efficiency in process.

BRIEF DESCRIPTION OF THE INVENTION

In accordance with the present invention, a billet is firstly made of an axially elongated core of an easily soluble material and a sheath wholly embracing the core and insoluble to the solvent for the core. In this stage of the process, a number of indentations are formed along the border between the core and the sheath which indentations function as the wick in the heat pipe produced. Next, the billet so prepared is subjected to an extrusion operation for reduction in the diameter and, finally, the core is removed by solution.

BRIEF EXPLANATION OF THE DRAWINGS

FIGS. 1 and 2 are transverse cross sectional plan views for showing the steps for producing a heat pipe in accordance with one embodiment of the present invention, FIG. 3 is a side plan view, partly in section, of the hydrostatic extrusion device during operation in accordance with the present invention, FIG. 4 is a transverse cross sectional plan view of a heat pipe produced in accordance with the present invention, and FIGS. 5 through 7 are transverse cross sectional plan views for showing the steps for producing a heat pipe in accordance with another embodiment of the present invention.

DETAILED DESCRIPTION OF THE INVENTION

In the following description, reference will be mainly made to embodiments in which hydrostatic extrusion is used for production of heat pipes. However, it should be noted that various types of extrusions other than hydrostatic extrusion may be employed with equal success in practicing the present invention.

One embodiment of the present invention is shown in FIGS. 1 through 4. Namely, in the first place, a sheath pipe 12 such as shown in FIG. 1 and having a number of axially elongated grooves 16 on the inner peripheral surface thereof is prepared. Preparation of such a sheath pipe 12 can be practiced either by applying suitable machine cutting to the inner surface of a material pipe or by casting. Next, a core 11 made of an easily soluble material is filled into the sheath pipe 12 and a billet 10 such as shown in FIG. 2 is obtained.

As already described, the core 11 is made of an easily soluble material, more preferably a water soluble salt. One typical example of such a water soluble salt contains sodium carbonate as the base, 30 to 50 percent by weight of potassium chloride and less than 10 percent by weight of sodium chloride. Further, salts such as sodium sulfate (mp. 884° C), sodium carbonate (mp. 852° C) and sodium chloride (mp. 800° C) are usable for the process according to the present invention. Such compound salts as 30 percent by weight of sodium chloride with 70 percent by weight of sodium carbonate (mp. 700° C), 50 percent by weight of potassium chloride with 50 percent by weight of sodium carbonate (mp. 610° C) and 80 percent by weight of potassium chloride with 20 percent by weight of calcium carbonate are also usable for the process according to the present invention. In general, the compound salts are better suited for the process of the present invention than the simple salts because they fit the casting extremely well due to their small rate of contraction in solidification caused by their relatively low melting point temperatures when compared with those of the simple salts.

The sheath pipe 12 is made of such a metallic material as aluminum, copper, brass, mild steel and their alloys, which is suited for plastic deformation by extrusion, particularly by hydrostatic extrusion.

The billet 10 so prepared is then subjected to extrusion on a hydrostatic extrusion device 20 shown in FIG. 3 which includes a cylinder 21 in which operating fluid 22 is contained, a die 23 disposed at the delivery end of the cylinder 21 and a ram 24 for applying pressure to the billet via the operating fluid 22.

Being pressed by the advancing ram 24 via the operating fluid 22, the billet 10 is extruded out of the device 20 through the die 23 and a rod 10 of a reduced diameter is obtained. This rod 10 is of a core-and-sheath construction too, i.e. it is composed of a core portion 110 and a sheath portion 120. It will be well understood that the transverse cross sectional profiles of the core and sheath portions 110 and 120 of the rod 110 are similar, though reduced in size, to those of the core rod 11 and the sheath pipe 12 of the billet 10 before the extrusion.

In other words, the surface ratio in the transverse cross section of the metal sheath to the salt core is maintained substantially unchanged before and after the extrusion. This is because both metals and salts present very little elastic deformation under such a high pressure application as 10,000 to 20,000 atmospheric pressure and this causes substantially no change in volume during the extrusion. In the case where the plastic deformation is obtained by hydrostatic extrusion, this constant surface ratio further results from the fact that the flow of the material in the hydrostatic extrusion is more uniform than that in the direct extrusion.

After the hydrostatic extrusion, the core portion 110 is removed by solution by, for example, blowing of steam in order to obtain a tubular body 200 such as shown in FIG. 4

This tubular body 200 has a transverse cross section similar to that of the sheath pipe 12 shown in FIG. 1 and a number of axially elongated grooves 216 thereof operate as a wick for assisting the flow of the operating fluid by their capillary action when the tubular body 200 is used as a heat pipe.

Another embodiment of the present invention is shown in FIGS. 5 through 7, in which a core 11 such as shown in FIG. 5 is prepared by compaction of salt such as rubber pressing or by casting. Next, machine cutting is applied to the core 11 in order to form a number of axially elongated peripheral grooves 17 as shown in FIG. 6. It is also possible to obtain the core 11 with the grooves 17 shown in FIG. 6 by casting without application of such machining. The core 11 so prepared is then set in a mold and a sheath 12 wholly embracing the core 11 is produced by casting a suitable metal into the mold. Thus a billet 10 such as shown in FIG. 7 is obtained in which the core 11 is wholly embraced by the sheath 12.

After application of the hydrostatic extrusion and later removal of the core by solution, a tubular body 200 such as shown in FIG. 4 is obtained. The peripheral grooves 216 of this tubular body correspond to the peripheral portions of the core 11 left between a pair of neighbouring peripheral grooves 17 (see FIG. 6) and function as the wick when the tubular body is used as a heat pipe.

In accordance with the present invention, the material used for the core is removed from the tubular body through solution at the final stage of the process and, in the practical mill production, it is on one hand not advantageous from the viewpoint of process cost to withdraw the material once dissolved for re-use. On the other hand, reduction of consumption of the material for the core surely leads to lowering of the production cost of the tubular body according to the present invention.

From these points of view, in a preferred embodiment of the present invention, it is advantageous to mix a number of beads into the core, which are made of such a material as glass which is insoluble to the solvent for the core material. After the removal of the core through solution, the beads can be re-collected for re-use in the next cycle of process. By mixing of such insoluble beans, consumption of the core material can remarkably be reduced leading to appreciable lowering in the production cost of the tubular body in accordance with the present invention.

The following examples are illustrative of the present invention but are not to be construed as limiting the same.

EXAMPLE 1

A copper pipe of 60mm. outer diameter, 4mm. thickness and 700 mm. length was used for the sheath and 72 axially elongated grooves of 1.0mm. width, 1.0mm. depth and 5° angular pitch were formed in the inner peripheral surface thereof by machining. Compound salt of potassium chloride with sodium carbonate (5 : 5) of 600° C melting point temperature and 40 Hv. hardness was used for the core. The ratio by weight of the copper with the compound salt was 28 : 100.

The deformation was carried out by hydrostatic extrusion in which the compaction ratio was 25.0 and the hydrostatic pressure was 14,000kg/cm$^2$. The compound salt core was removed by steam blowing.

The tubular body so obtained was almost similar to the original sheath in the transverse cross sectional profile thereof. That is, the outer diameter of the tubular body was 12mm., the thickness was 0.8mm., the width of the axial grooves was 0.2mm. and the depth thereof was 0.2mm. It was confirmed that the tubular body so obtained could advantageously be used for the heat pipe with the axial grooves functioning extremely well as the wick for the operating fluid.

EXAMPLE 2

A material core of 56mm. diameter and 500mm. length was formed in sodium chloride and a machining was applied to this material core in order to produce a core of 54mm. diameter. A further machining was applied to this core in order to form 72 axially elongated grooves of 1mm. width and depth. This core was set coaxially within a round mold and aluminum was cast into the cylindrical cavity around the core.

The billet so obtained was then subjected to hydrostatic extrusion in which the compaction ratio was 25.0 and the hydrostatic pressure was 6,000kg/cm$^2$. Removal of the salt core was carried out by steam blowing.

The tubular body so obtained had an outer diameter of 12.8mm., a thickness of 1mm. and 72 inner axial grooves of 0.2mm. width and depth. It was confirmed that the aluminum tubular body could advantageously be used for the heat pipe with the inner axial grooves providing excellent operation functioning as the wick.

As is clear from the foregoing description, employment of the present invention in the production of heat pipes assures provision of heat pipes having wicks of sufficiently high capillary action, remarkably enhanced precision in process even with high compaction ratio and high efficiency in the production process. Further, mixing of the insoluble but later removable beads in the core results in reduced consumption of the core salt and reduced trouble of pollution of environment.

We claim:

1. A process for producing a heat pipe, comprising the steps of:

forming a billet comprising a water soluble salt core and an axially elongated non-water soluble sheath, said sheath including a plurality of axially extending capillary grooves formed along the inner periphery thereof, said salt core filling the interior of said sheath including said axially extending capillary grooves;

subjecting said billet to compulsory plastic deformation by extrusion in such a manner that the dimensions of said sheath, including the dimensions of said capillary grooves, as measured in the radial direction are reduced; and thereafter removing said core through solution in water to obtain said heat pipe.

2. A process for producing a heat pipe as claimed in claim 1 wherein said extrusion is hydrostatic extrusion.

3. A process for producing a heat pipe as claimed in claim 1 wherein said water soluble salt is a simple salt chosen from a group composed of sodium sulfate, sodium carbonate and sodium chloride.

4. A process for producing a heat pipe as claimed in claim 1 wherein said water soluble salt is a compound salt including sodium carbonate as the base, 30 to 50 percent by weight of potassium chloride and less than 10 percent by weight of sodium chloride.

5. A process for producing a heat pipe as claimed in claim 1 wherein said water soluble salt is a compound salt including 30 percent by weight of sodium chloride and 70 percent by weight of sodium carbonate.

6. A process for producing a heat pipe as claimed in claim 1 wherein said water soluble salt is a compound salt including 50 percent by weight of potassium chloride and 50 percent by weight of sodium carbonate.

7. A process for producing a heat pipe as claimed in claim 1 wherein said water soluble salt is a compound salt including 80 percent by weight of potassium chloride and 20 percent by weight of calcium carbonate.

8. A process for producing a heat pipe as claimed in claim 1 wherein said sheath is made of a metallic material.

9. A process for producing a heat pipe as claimed in claim 8 wherein said metallic material is chosen from a group composed of aluminum, copper, brass, mild steel and their alloys.

10. A process for producing a heat pipe as claimed in claim 1 wherein said step of removing said core from said billet is carried out by blowing of steam.

11. A process for producing a heat pipe as claimed in claim 1 wherein a number of non-water soluble beads are mixed into said core.

12. A proces for producing a heat pipe as claimed in claim 1 wherein said step of forming a billet includes the steps of:

forming a sheath pipe having a number of axially elongated grooves in the inner peripheral surface thereof; and inserting said water soluble core into the cavity of said sheath pipe such that said core completely fills said cavity including said grooves.

13. A process for producing a heat pipe as claimed in claim 12 wherein said sheath is formed by machine cutting an inner cavity of a material pipe.

14. A process for producing a heat pipe as claimed in claim 12 wherein said sheath is formed by casting.

15. A process for producing a heat pipe as claimed in claim 1 wherein said step of forming said billet includes the steps of:

forming a material core by compaction;

forming a number of axially elongated grooves in the periphery of said material core;

setting said material core in a mold; and casting a metallic material between said core in said mold whereby said grooves are formed along said border between said core and said sheath.

16. A process for producing a heat pipe as claimed in claim 15 wherein said grooves are formed by machine cutting.

17. A process for producing a heat pipe as claimed in claim 15 wherein said grooves are formed by casting.

* * * * *